US009357884B2

(12) United States Patent
Cook

(10) Patent No.: US 9,357,884 B2
(45) **Date of Patent: *Jun. 7, 2016**

(54) WATERPROOF JUNCTURE

(71) Applicant: Joseph R. Cook, Parkland, FL (US)

(72) Inventor: Joseph R. Cook, Parkland, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/328,314

(22) Filed: Jul. 10, 2014

(65) Prior Publication Data

US 2015/0074897 A1 Mar. 19, 2015

Related U.S. Application Data

(63) Continuation of application No. 12/435,959, filed on May 5, 2009, now Pat. No. 8,789,316.

(51) Int. Cl.

| | |
|---|---|
| ***A47K 3/16*** | (2006.01) |
| ***A47K 3/00*** | (2006.01) |
| ***A47K 3/30*** | (2006.01) |
| ***E04B 1/64*** | (2006.01) |
| ***E04B 1/68*** | (2006.01) |

(52) U.S. Cl.

CPC . *A47K 3/008* (2013.01); *A47K 3/30* (2013.01); *E04B 1/64* (2013.01); *E04B 1/6803* (2013.01)

(58) Field of Classification Search

CPC ..... A47K 3/04; A47K 3/008; A47K 3/16; A47K 3/284; A47K 3/30; A47K 3/40; E06B 2001/628; E06B 1/62; E04B 1/7046; E04B 1/64; E04B 1/6803

USPC ..... 52/34, 35, 58, 62, 169.12, 169.5; 4/584, 4/612–614

See application file for complete search history.

(56) References Cited

U.S. PATENT DOCUMENTS

| | | | | |
|---|---|---|---|---|
| 2,031,255 A * | 2/1936 | Deubelbeiss | ..... | A47K 3/008 4/538 |
| 2,145,215 A * | 1/1939 | Sakier | ..... | A47K 3/008 4/538 |
| 2,677,268 A * | 5/1954 | Hobbs | ..... | A47K 3/008 4/614 |
| 3,134,197 A * | 5/1964 | McColley | ..... | A47K 3/008 52/254 |
| 4,578,832 A * | 4/1986 | Primucci | ..... | A47K 3/284 4/584 |

(Continued)

*Primary Examiner* — Brian Glessner
*Assistant Examiner* — Adam Barlow
(74) *Attorney, Agent, or Firm* — Kevin P. Crosby; GrayRobinson, P.A.

(57) ABSTRACT

A waterproofing flashing and resulting juncture, comprising in a first embodiment a generally horizontally positioned planar member which is positioned in sandwiched engagement between the upper peripheral edge of a shower pan or shower bench sidewall (or equivalent wallboard) and a lower peripheral edge of adjacent wallboard (or equivalent shower bench, shelf or ledge), and a vertically extending member attached to a distal edge of the horizontal member extending vertically upwardly behind the wallboard (or equivalent shower bench, shelf or ledge). An alternative form of the invention comprises a T-shaped flashing member comprised of a mid-section to which are connected first and second attachment members or wings, the wings adapted to connect the flashing to the room-facing side of the wallboard and/or shower module sections. A further version of the invention comprises a waterproof juncture comprised of a water-impermeable membrane applied over at least the upper peripheral edge of a wallboard or shower pan sidewall and a portion of an adjacent wall-forming member which is coplanar with the wall studs, which in turn will form a waterproof covering over the seam between the upper peripheral edge of the wallboard or shower pan sidewall (or equivalent shower bench, shelf or ledge) and the adjacent wall-forming member.

15 Claims, 11 Drawing Sheets

(56) References Cited

U.S. PATENT DOCUMENTS 4,750,967 A * 6/1988 Kott ..... B29C 51/162 156/499
5,950,370 A * 9/1999 Peck ..... A47K 3/008 4/584
5,997,009 A * 12/1999 Geise ..... A47K 3/008 277/650
2005/0210577 A1* 9/2005 Sisk ..... A47K 3/30 4/614
2010/0325969 A1* 12/2010 Hourihan ..... A47K 3/008 52/35

* cited by examiner

WATERPROOF JUNCTURE

CROSS-REFERENCE TO RELATED APPLICATIONS

The present application is a continuation of co-pending U.S. patent application Ser. No. 12/435,959 filed May 5, 2009 entitled "Waterproof Juncture," the contents of which are fully incorporated by reference herein for all purposes.

BACKGROUND ART

Field of Invention

This invention relates generally to the field of waterproofing joints, and more particularly relates to a flashing adapted to reduce or eliminate intrusion of water behind wallboard and/or modular shower pans and/or shower benches and related accessories (i.e. shower niches and shower ledges).

Growth of molds in and about showers and shower enclosures has been identified as a substantial health problem in certain parts of the country. Efforts which address the problem can be found in the following United States Patents; U.S. Pat. No. 6,138,295; U.S. Pat. No. 5,705,002; U.S. Pat. No. 5,435,021; U.S. Pat. No. 5,203,640; U.S. Pat. No. 5,159,723; U.S. Pat. No. 4,837,997; and U.S. Pat. No. 4,299,064.

None of these references, however, address the problem with the use of a thin flashing located between, adjacent to, or straddling seams formed by adjacent wallboards, and/or adjacent shower benches and shower pans, and/or adjacent shower benches and wallboards, and or adjacent shower pans and wallboards, and/or adjacent shower accessories and wallboard, and/or adjacent shower/tub enclosure members and any of the foregoing.

The construction of a tiled stand-up shower is made substantially simpler by the employment of a waterproof, unitary, shower pan or module, such as the pan disclosed in U.S. Pat. No. 5,913,777 issued on Jun. 22, 1999 to Gerber. Pans of this type are comprised generally of a sloping floor into which is formed a drain opening, and sidewalls extending substantially upwardly from peripheral edges of the pan floor. The sidewalls terminate at a height which is intended to coincide with a lower peripheral edge of the wallboard out of which the shower wall substrate is formed. The interface of the pan sidewall with the wallboard forms a continuous planar surface over which tile or other surface material may be installed.

Of particular concern to the shower designer and installer is downflowing water due to gravity getting behind the tiles or other surface material that make up the shower walls. It is a common, yet highly undesirable, occurrence for such water to migrate into the space between the upper peripheral edges of the shower pan sidewalls and the lower peripheral edges of the wallboard, or between adjacent sections of wallboard, which in turn creates discoloration, odor and mold.

SUMMARY OF THE INVENTION

It is, therefore, an object of this invention to provide a waterproofing measure which is inexpensive, unobtrusive, highly effective and very simple to install and used in the installation of adjacent wallboard sections, and/or shower pans and adjacent wallboard, and/or shower pans and one or more adjacent shower benches, and/or one or more shower benches and adjacent wallboard, and/or shower accessories and adjacent wallboard It is also an object of this invention to improve the waterproofing characteristics of a stall shower installation.

These and other objects are realized by the use of a novel flashing element sandwiched between and/or upon spanning adjacent sections of a shower pan and/or a shower bench and/or adjoining sections of wallboard and/or shower accessories and/or shower/tub enclosures.

In the preferred embodiment, the flashing may be either "z" or "h" shape. In the preferred embodiment, the invention includes a horizontally positioned water-impervious planar member which is adapted to be positioned in sandwiched engagement between a generally horizontally oriented space formed by the upper peripheral edge of one or more of a pan sidewall or a lower wallboard section or a bench sidewall, or a lower shower accessory, such as a shampoo niche, shelf or ledge and the lower peripheral edge of one or more of an upper wallboard section on bench leg rest or shower accessory or other shower/tub enclosure element, and a vertically upwardly extending water-impervious member attached to a distal edge of the horizontal member and extending vertically upwardly behind the upper wallboard section and/or upper bench section and/or upper shower accessory section or other shower/tub enclosure element.

Water which would otherwise penetrate the joint between the top peripheral edge of the pan sidewall or shower bench or shower accessory or wallboard and the lower peripheral edge of the wallboard or shower bench or shower accessory, is prevented from seeping or flowing behind the wallboard, pan sidewall or the bench or the shower accessory by the novel flashing member of this invention in a manner to be described more fully hereinafter.

Alternatively, for sealing generally vertically oriented seams, the flashing may be formed from one or more of a length of "T" or "L"-shaped water-impermeable material wherein (i) the bottom section of such "T"-shape is adapted to be placed between the two adjacent planar surfaces and/or (ii) the "T" or "L" shape is adapted to be placed over and/or between two adjacent angled surfaces, when such adjoining surfaces are either wallboards or wallboard/shower pan or wallboard/shower bench or wall board/shower, and the first and second arms extending outwardly from the bottom section of the "T" and both arms of the "L" are sealingly attached to respective surfaces of the adjacent wallboard/wallboard or wallboard/shower pan or wallboard/shower bench or wallboard/shower accessory.

Water which would otherwise penetrate the joint between the adjacent edges of the one or more of the pan sidewall, shower bench, shower accessory and wallboard, is prevented from seeping or flowing behind the wallboard or the pan sidewall or the shower bench or the shower accessory by the alternative flashing member of this invention in a manner to be described more fully hereinafter. Other alternative forms of the invention are disclosed further herein.

In describing my invention, reference is sometimes made to the juncture between a sidewall of a shower module or pan, and the lower peripheral edge of one or more adjacent sections of wallboard. It is to be understood throughout this disclosure that my invention is intended to, and does, encompass the: (1) the horizontal and vertical junctures of a shower pan sidewall and adjacent section(s) of wallboard; (2) the vertical and horizontal junctures of adjacent wallboard sections; (3) the vertical and horizontal junctures of a shower bench and adjacent wallboard; and (4) the vertical and horizontal junctures of a shower bench and shower pan; and the vertical and horizontal junctures of a shower accessory and wallboard.

DETAILED DESCRIPTION OF THE PREFERRED AND ALTERNATE EMBODIMENTS

Figure 1:
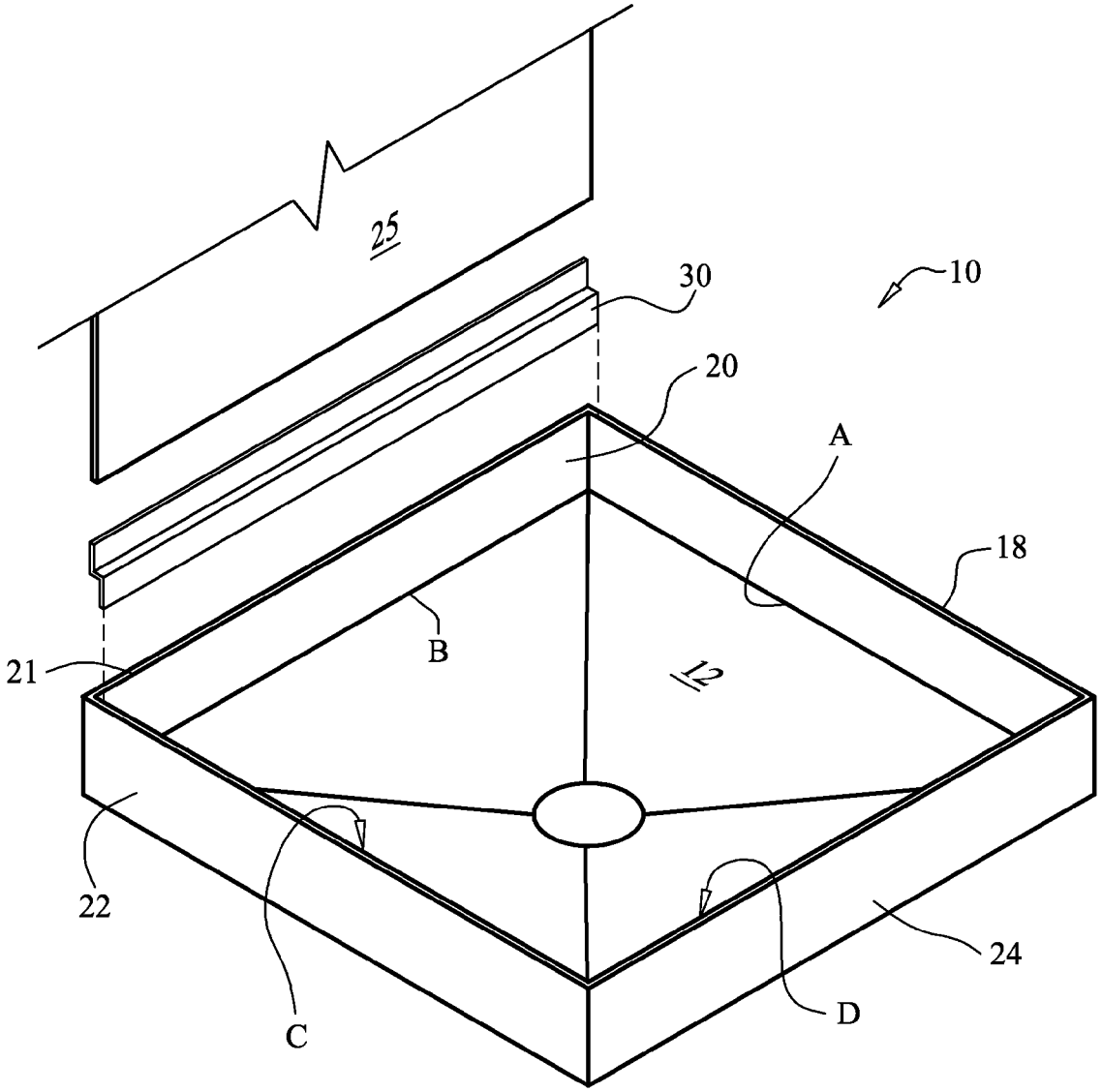
FIG. 1 is a perspective exploded view of a representative application of a first embodiment of the invention.

Before describing in detail exemplary embodiments that are in accordance with the present invention, it should be observed that the embodiments reside primarily in combinations of apparatus components and processing steps related to implementing a method for reducing the tendency for water to be permitted to intrude behind wallboard and/or shower pan and bench structures, and/or shower accessories and to improving the performance of the associated shower enclosure. Accordingly, the apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms, such as "first" and "second," "top" and "bottom," and the like, may be used solely to distinguish one entity or element from another entity or element without necessarily requiring or implying any physical or logical relationship or order between such entities or elements. The terms "comprises," "comprising," or any other variation thereof are intended to cover a non-exclusive inclusion, such that a process, method, article, or apparatus that comprises a list of elements does not include only those elements, but may include other elements not expressly listed or inherent to such process, method, article, or apparatus. The term "plurality of" as used in connection with any object or action means two or more of such object or action. A claim element proceeded by the article "a" or "an" does not, without more constraints, preclude the existence of additional identical elements in the process, method, article, or apparatus that includes the element. The term "tile" also encompasses "stone", "marble", stucco, plaster, or any other wall covering material. The term "tiled" means any surface having tile, stone, marble, stucco, plaster, or any other wall covering material applied thereon. The terms "wall" or "sidewall," in relation to a shower module or shower bench and enclosures for same, means any component of a shower module or shower bench or shower accessory or wallboard which makes up any portion of a shower or tub enclosure, including wallboard, a shower module/pan, a curb or sidewall integrated into such shower module/pan, or any portion of a shower bench, shelf or ledge.

Referring now to the drawings, FIG. 1 shows a representative modular shower pan 10 comprised of a floor section 12 having one or more upstanding sidewalls 18, 20, 22 and 24 connected to peripheral edges A, B, C and D of floor 12 in a manner that will be readily apparent to those of skill in the art. Pan 10 is preferably but not by way of limitation of the type disclosed in U.S. Pat. No. 5,913,777 issued on Jun. 22, 1999 to Gerber. The disclosure of the '777 Patent is incorporated herein by reference as though fully set forth herein. Pans of this type are comprised generally of a sloping floor into which is formed one or more drain openings, and sidewalls extending substantially upwardly from peripheral edges of the pan floor. The sidewalls terminate at a height which is intended to coincide with a lower peripheral edge of wallboard, bench or ledge component out of which the shower enclosure is formed. Specifically, the pan or shower bench/ledge sidewalls terminate at peripheral edges which are positioned at a height which is intended to substantially coincide with the lower peripheral edge 26 of the wallboard, bench or ledge component as shown in FIG. 3A.

Figure 2:
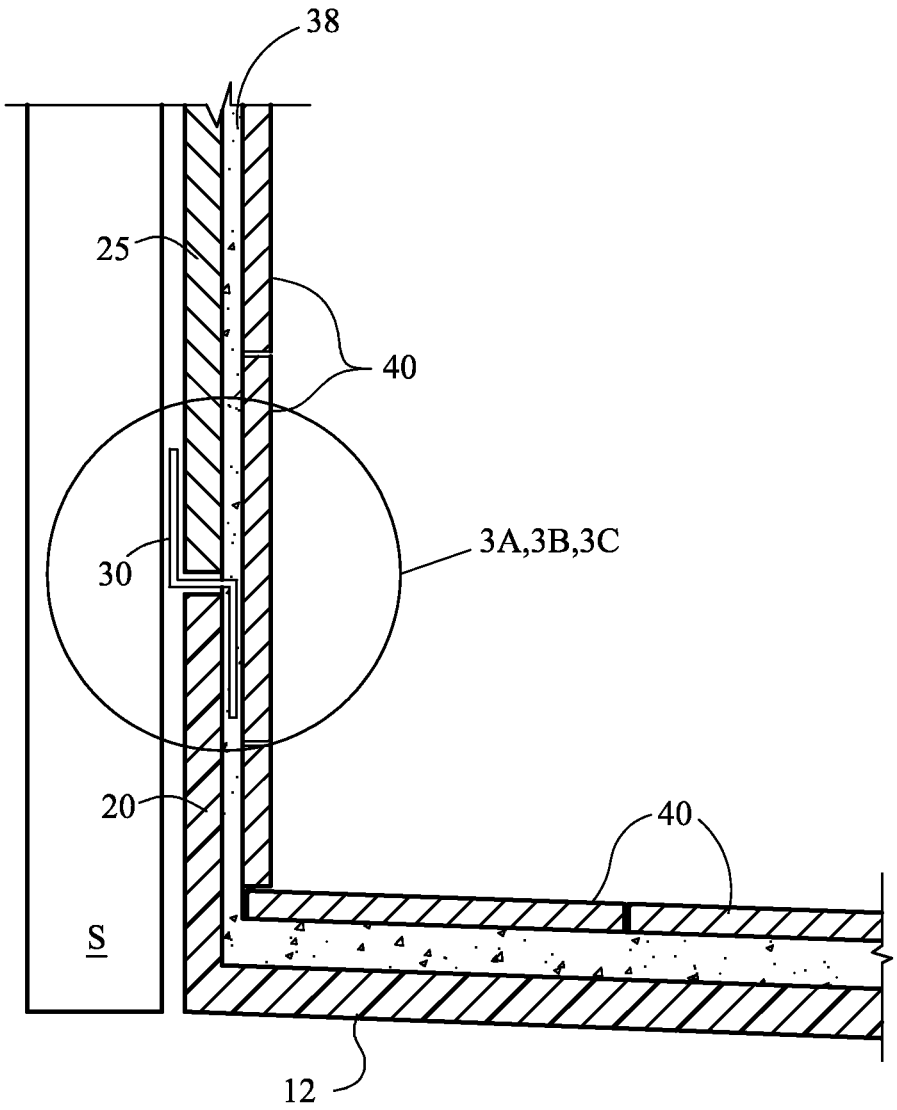
FIG. 2 is a cross sectional elevational view of a fully assembled shower employing the first embodiment of the invention.
Figure 3A:
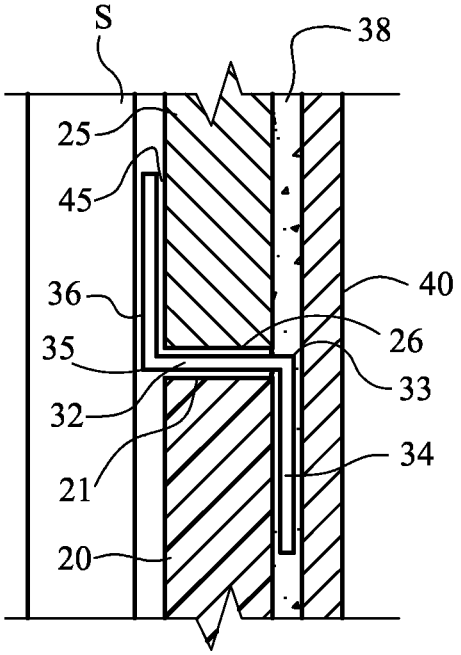
FIG. 3A is an enlarged view of the area of detail circled in FIG. 2.

A waterproofing member such as flashing 30 is positioned in the space created between the lower peripheral edge 26 of wallboard 25 and the upper peripheral edge 21 of wallboard/pan or bench/ledge sidewall 20, as shown in FIG. 3A. Flashing member 30 is preferably "z" shaped, comprised of a central flat horizontal member 32, a downwardly extending horizontal proximal leg member 34 connected at a proximal edge 33 of horizontal member 32, and an upwardly extending distal leg member 36 connected to a distal edge 35 of horizontal member 32. In its assembled form, as best seen in FIGS. 2-3, flashing member 30 is attached (via fastener, adhesive or any suitable connecting structure) to a shower frame member such as wall stud "S", or any other suitable supporting surface, prior to installation of the wallboard 25, but preferably after installation of pan 10. Horizontal flashing member 32 is positioned on top of and preferably, but not by way of limitation, in contact with upper pan sidewall peripheral edge 21 and inside sidewall peripheral edge 23. Wallboard 25 is then installed, and finishing/wallcovering material 38/40 applied there over. The finishing/wallcovering material 38/40 may be in any form, such as tiles and grouting, stucco, plaster or the like, placed there over such that the horizontally projected area occupied by the flashing and the space, i.e. seam, between the members 20, 25 is covered thereby by. Alternatively, as stated above, flashing 30 may also be employed in seams formed between adjacent wallboard sections, shower pan and bench sections, shower benches and adjacent wallboard and/or shower accessories and wallboard, whether those seams are horizontally or vertically oriented. Finishing/wallcovering materials are likewise then used to cover the projected area occupied by the flashing and the seam.

Flashing member 30 may be of any length, but is preferably coextensive with the seam being waterproofed.

As can be appreciated, and as shown in FIGS. 2-5, the thickness "t" of flashing 30 should be sized so as not to have any appreciable affect on the thinset layer 38 so that tiles 40 can be placed across the intersection of wallboard 25 with pan sidewall 20 without any undulation or disturbance of the flat surface formed by the tile.

Also, the height "$h_1$" of upstanding leg 36 of flashing 30 can be any suitable height and is preferably in the range of ¼" to 4". The width "w" of horizontal member 32 should be sized so as to substantially coincide with the thickness of wallboard/pan sidewall 20 and/or wallboard 25. The height $h_2$ of depending legs 34 or 37 can be any height, e.g. 1/16" to 4".

The function of flashing 30 is to prohibit water which has intruded behind tiles 40 into and/or behind thinset 38 from traveling behind wallboard 25 or wallboard/pan sidewall 20. This occurs due to the vertical member 36 acting as a barrier to water which has seeped into any gap between lower peripheral edge 26 of wallboard 25 and upper peripheral edge 21 of shower component 20 resulting from the downflow of water due to gravity. Any such water will be constrained to the space 45 between wallboard 25 and vertical flashing member 36 and space 38.

Figure 3B:
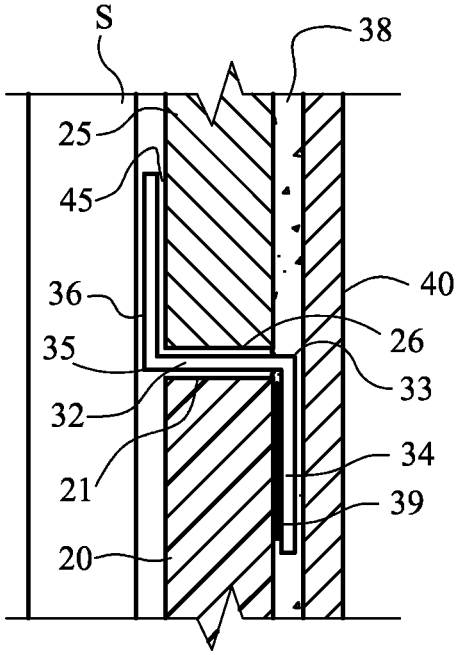
FIG. 3B is an enlarged view of the area of detail circled in FIG. 2, with the further modification of having a bead of adhesive and/or caulking placed between leg 34 and sidewall or wallboard section 20.
Figure 3C:
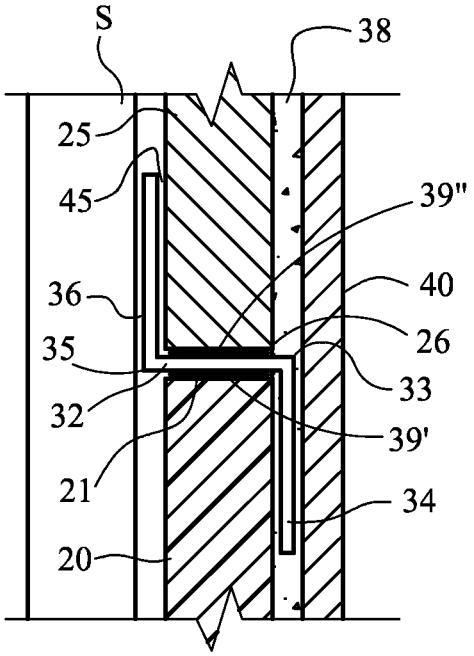
FIG. 3C is an enlarged view of the area of detail circled in FIG. 2, with the further modification of having an additional or alternative bead of adhesive and/or caulking 39" placed between lower edge 26 of wallboard or shower bench wall 25 and pan or bench sidewall upper edge 21.
Figure 4:
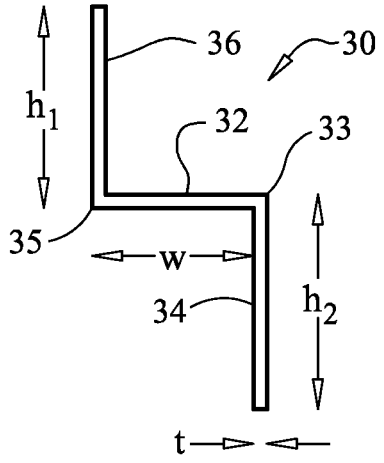
FIG. 4 is a side elevational view of the preferred embodiment of the invention.

FIG. 3B is an enlarged view of the area of detail circled in FIG. 2, with the further modification of having a bead 39 of adhesive and/or caulking sealingly placed between leg 34 and sidewall or wallboard section 20. In this way, a further level of waterproofing is achieved, as any water rising between tile 40 and wallboard/sidewall 20 will be prevented from passing beyond bead 39, so that water cannot rise to a level where it overflows peripheral edge 21 and passes down behind (to the left in FIG. 3B) wallboard/sidewall 20. FIG. 3C is the same view as FIG. 3B, but a bead 39' of adhesive and/or caulk is sealingly placed between upper peripheral edge 21 and flashing horizontal member 32. Obviously, a bead 39 may be placed in either or both locations simultaneously if desired. Further, another bead 39" may be placed between lower edge 26 of wallboard 25 (or the lower edge of bench wall 55) and flashing member 32. Beads 39, 39' and 39" are preferably continuous and coextensive with flashing member 30.

Figure 5:
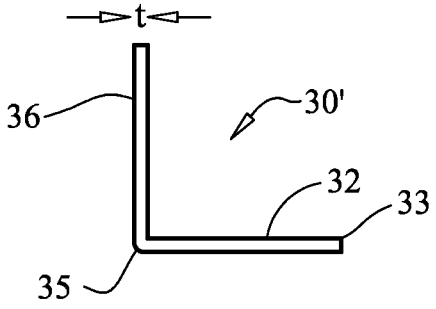
FIG. 5 is a side elevational view of a modified form of the invention.

Referring now to FIG. 5, an alternative form of flashing 30' is shown, wherein the downwardly depending front leg 34 of flashing 30 has been omitted. Flashing 30 in this configuration is otherwise installed and performs substantially identically to that described in connection with FIGS. 2-4.

Figure 6:
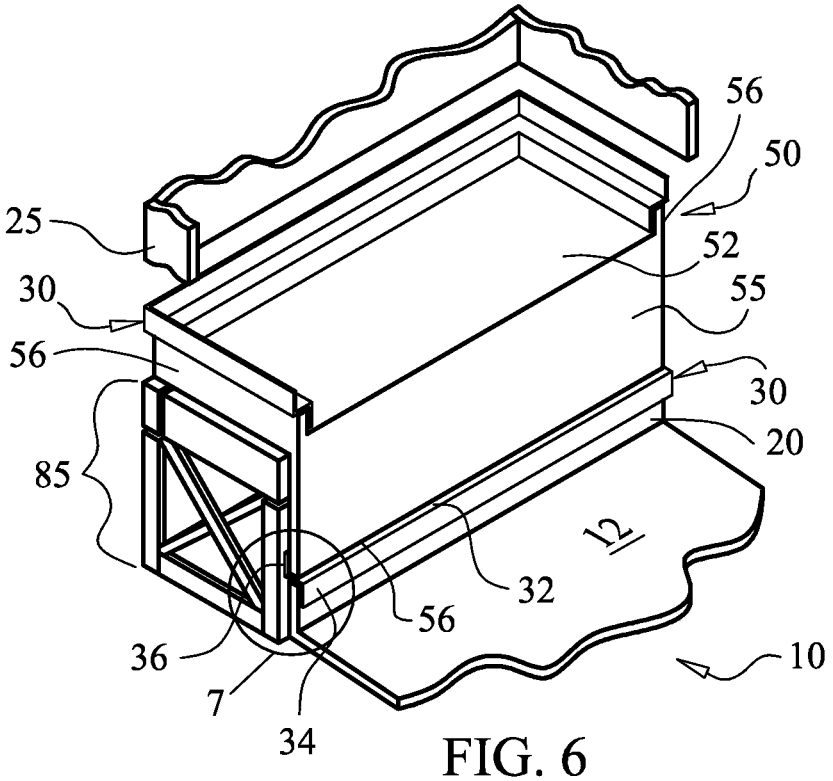
FIG. 6 is a perspective view of the preferred embodiment of the invention employed in connection with a novel prefabricated modular shower bench.
Figure 7:
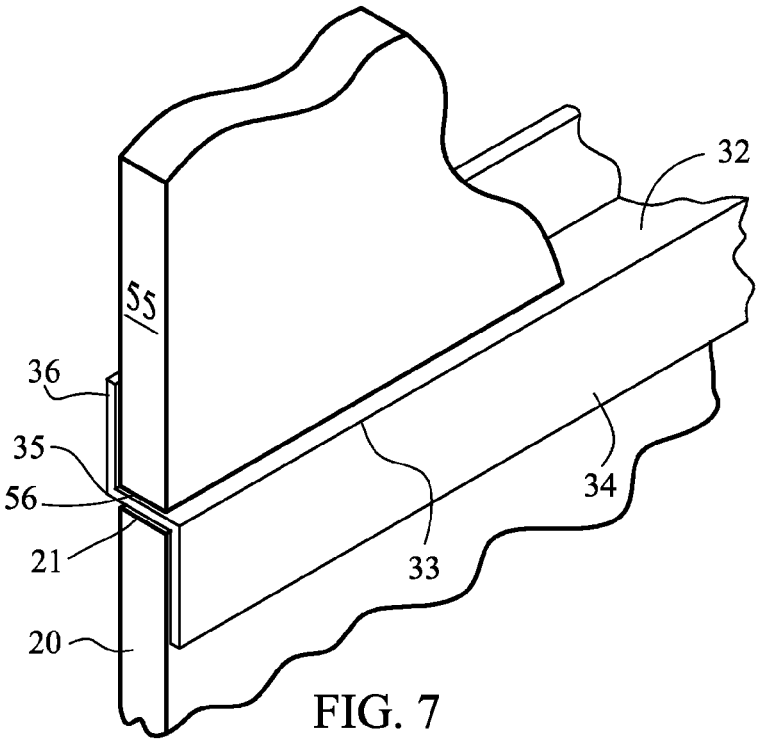
FIG. 7 is a close up of the area of detail circled in FIG. 6.

FIG. 6 is a perspective, partially exploded view of an application of the invention to a shower bench/shower pan arrangement. A shower pan module 10 is installed in a shower enclosure (not shown) and, as in the case of FIGS. 1-3, includes a floor 12 and at least one upstanding sidewall 20 ending in an upper peripheral sidewall edge 21.

A shower seat module 50, which in the figure is shown as a simple bench, but may be made in any shape, has a generally horizontally extending seating section 52, a vertical leg panel 55 depending downwardly there from, and a backrest section 56 extending generally vertically there from. Shower seat 50 may be supported in any desired manner, such as by wood or metal framing "R", support ribs (not shown) attached to or otherwise associated with bench 50, or the like. In the embodiment shown in FIG. 6, seat 50 is supported by a support structure 85 such as wall studs, plywood sheeting molded-in ribs, or the like, as will occur to those of skill in the art.

Leg panel 55 ends in a lower peripheral edge 56 which is adapted to substantially align with upper peripheral edge 21 of pan sidewall 20 in a manner similar to that shown in connection with FIGS. 2 and 3 with respect to wallboard 25. In other words, leg panel 55 will align with, and create a space between itself and, pan sidewall 20 in the same manner that wallboard 25 aligns with pan sidewall 20 in FIGS. 2 and 3. Flashing 30 is disposed in the space between peripheral edges 21 and 56 so as to sandwich horizontal flashing member 32 there between. The modified flashing 30 shown in FIG. 5 (or that shown in FIG. 8) may also be employed in the context of the arrangement shown in FIG. 6 without departing from the spirit and scope of this invention. In such event, downwardly depending flashing member 34 may or may not be omitted. Flashing 30 is also used to create a waterproof barrier at the junction of wallboard 25 and seat back 56 as shown in the drawing in the same manner as described in connection with FIGS. 2 and 3.

It is to be understood that flashing 30 may be employed at any junction of wall section elements where waterproofing is desired. For example, a typical shower pan 10 will have one or more upstanding sidewalls which will mate with adjoining wallboard or other module accessories such as shower seat 50 to form substantially horizontal seams. At all such junctures, wherever waterproofing is desired, flashing 30 may be installed. As stated above, the invention may also be employed at the juncture of wallboard sections, regardless of whether a shower pan or bench is associated with such juncture.

Figure 8:
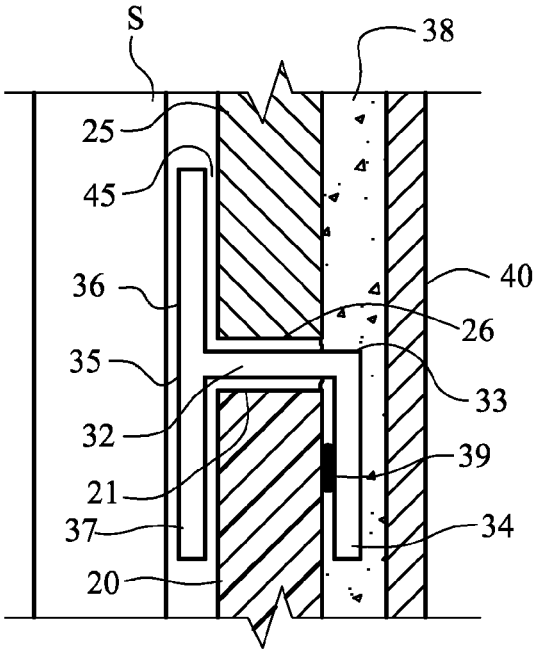
FIG. 8 is an enlarged view of the area of detail circled in FIG. 2, with the further modification of having a downwardly depending rear leg connected to the flashing member.

FIG. 8 is an enlarged view of the area of detail circled in FIG. 2, with the further modification of having a downwardly depending leg 37 attached to the distal edge 35 of horizontal member 32. Leg 37 provides additional stability to flashing member 35 as it permits legs 36 and 37 to straddle the wall member 20. One or more fasteners such as sheet metal screw 41 (shown in FIG. 9) may be used to connect leg 37 to a wall stud "S" or other framing member.

Figure 9:
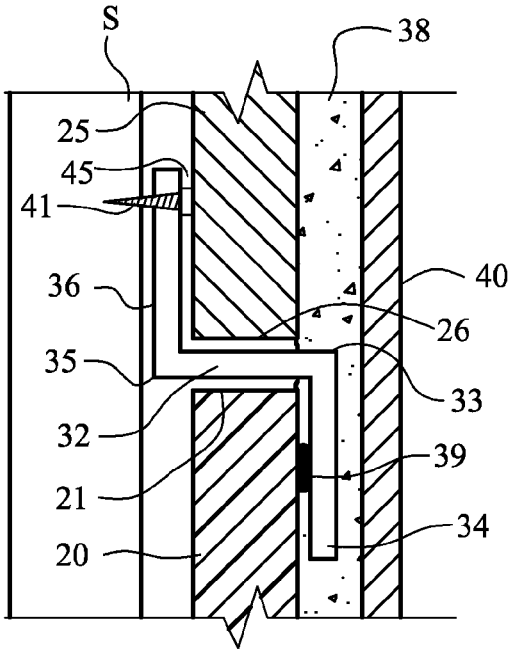
FIG. 9 is an enlarged view of the area of detail circled in FIG. 2, with the further modification of having a fastener which mechanically connects flashing 30 to an adjacent wall stud S.

FIG. 9 is an enlarged view of the area of detail circled in FIG. 2, with the further modification of having a fastener 41 such as one or more sheet metal screws, adhesive, clamps, etc. mechanically connecting flashing 30 to wall stud "S". Alternatively, or additionally, fasteners 41 may be used to mechanically connect flashing 30 to sidewall or wallboard peripheral edge 21 or 26. Additionally, adhesive/caulk bead 39 may be replaced by one or more fasteners 41.

Figure 10:
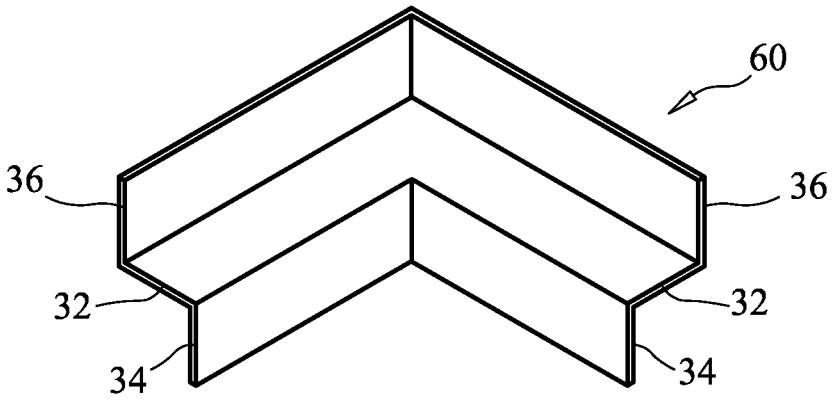
FIG. 10 is a front perspective view of a corner flashing member in accordance with the principles of this invention.

FIG. 10 is a front perspective view of a corner flashing member 60 in accordance with the principles of this invention. The flashing member 60 is preferably formed of a one piece construction, as by injection molding, stamping or the like depending upon the material used. Alternatively, the corner flashing member 60 may be formed in situ by an installer by cutting straight sections and installing them to form a corner. The angle formed by corner member 60 may be 90° or any other angle to fit a particular application.

Figure 11:
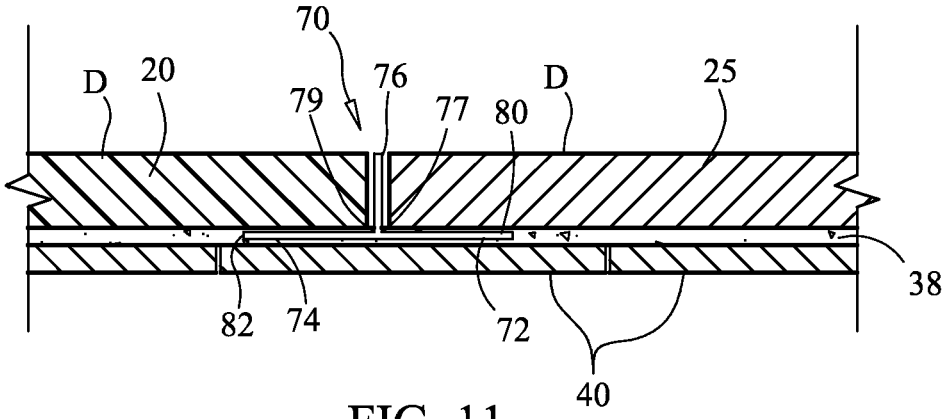
FIG. 11 is a cross-sectional top plan view of a modified form of flashing member in accordance with this invention.
Figure 12A:
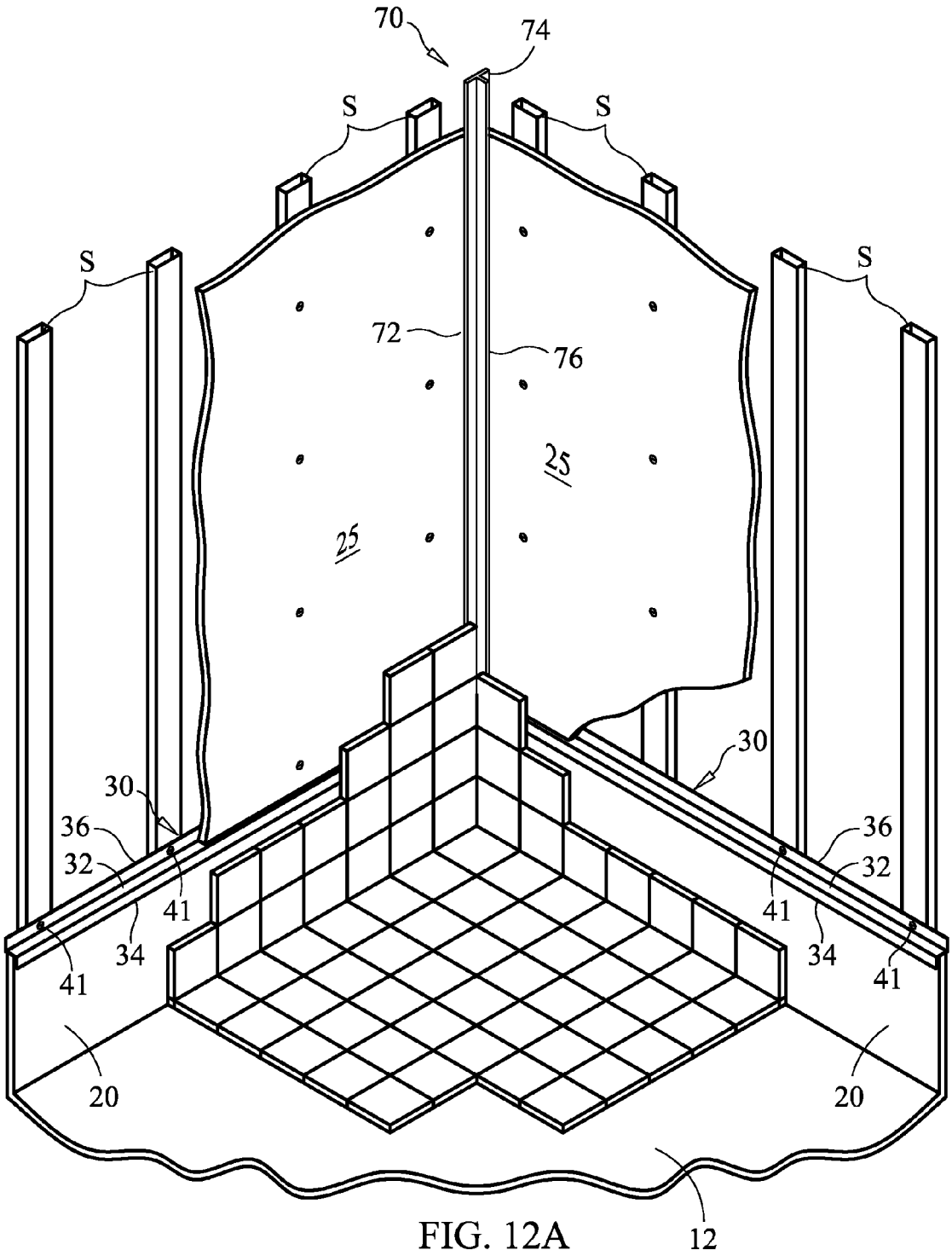
FIG. 12A is a perspective view of the flashing assembly shown in FIGS. 1-10 together with the modified form of flashing member shown in FIG. 11, installed in a shower.
Figure 12B:
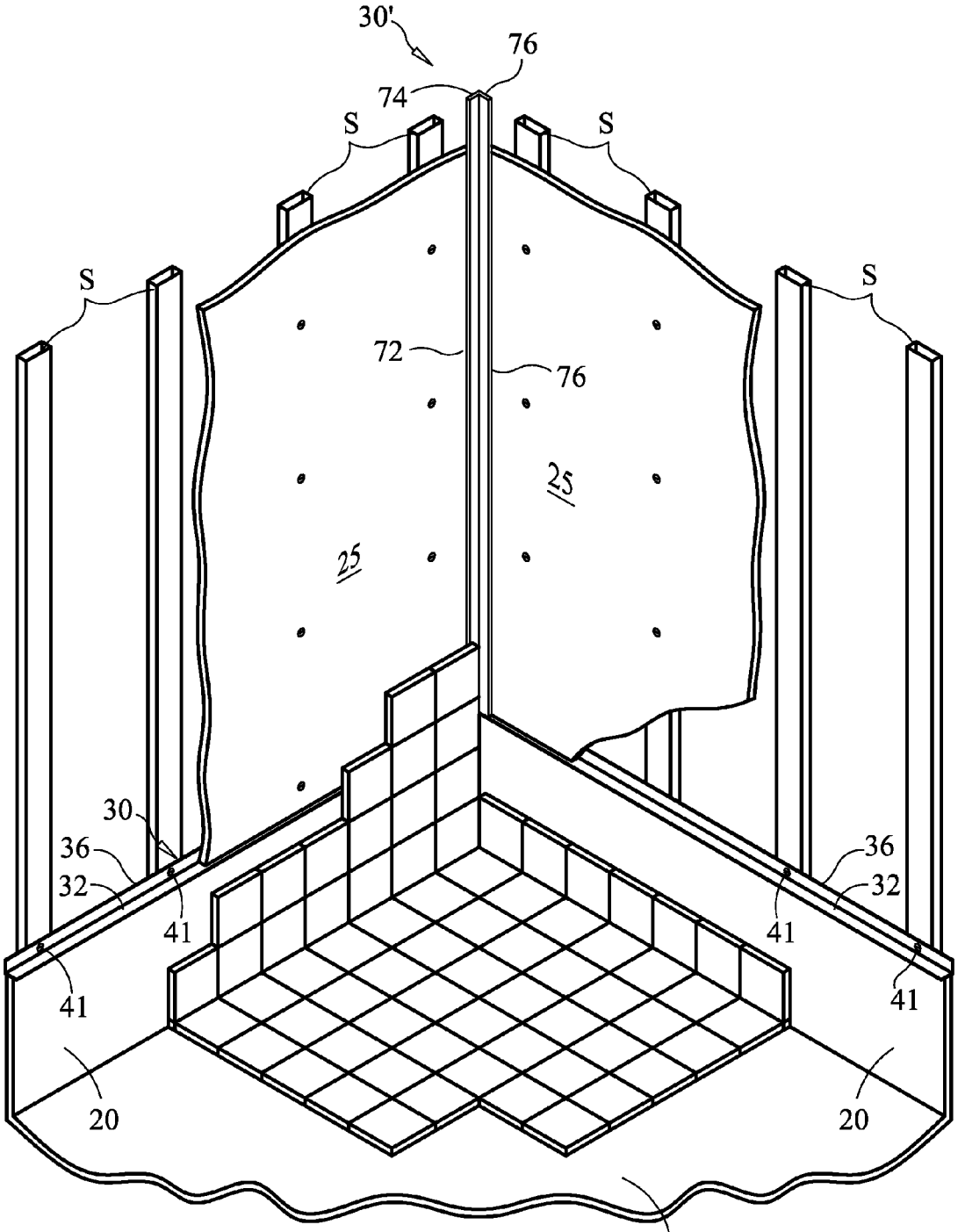
FIG. 12B is the perspective view of FIG. 12A with the modified form of flashing assembly shown in FIG. 5, installed in place of the modified form of flashing member shown in FIG. 11.
Figure 13:
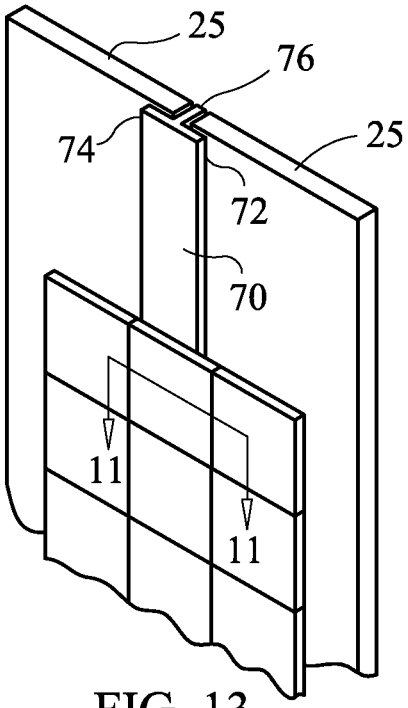
FIG. 13 is a perspective view of the flashing of FIG. 11 installed between adjacent wallboard sections.
Figure 14:
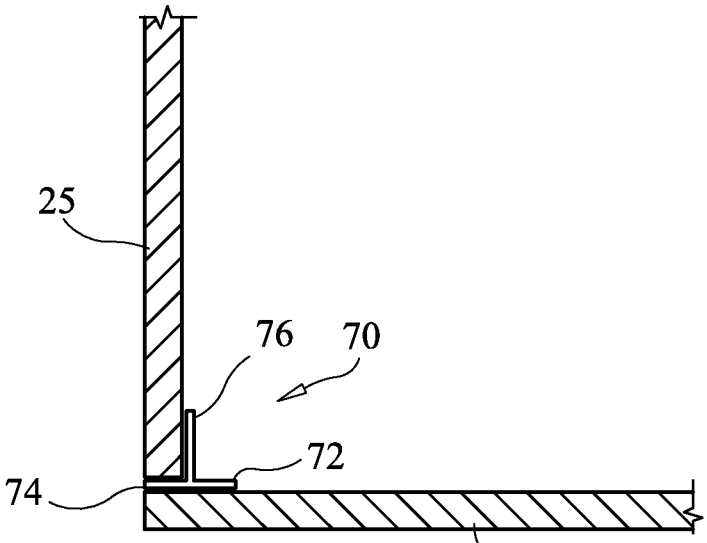
FIG. 14 is a top plan view of the flashing of FIG. 11 installed between adjacent wallboard sections.

FIGS. 11-14 illustrate another embodiment of the invention. FIG. 11 is a cross-sectional plan view of a modified flashing member according to my invention. In this embodiment, a T-shaped flashing member 70 is adapted to be placed in the substantially vertically oriented space between adjacent wallboard sections 25 and/or between wallboard sections and adjacent shower/tub enclosure components. Flashing member 70 is comprised of a first arm 72, a second arm 74, and a mid-section 76. Mid-section 76 terminates in a first peripheral edge 77 and a second peripheral edge 79. Arms 72, 74 are connected to mid-section 72 along first and second peripheral edges 77, 79, respectively, and are in turn sealingly connectable to the room-facing (i.e. shower interior-facing) surfaces F of sections 20 and/or 25 being joined, as by adhesive and/or caulk beads 80 and 82 or other mechanical fastener such as one or more screws, adhesive tape, waterproof membrane, etc. Mid-section 76 is formed of a water impermeable material so as to create a water barrier which prevents the intrusion of water behind sections 20, 25. Flashing member 70, as with all other flashing members disclosed herein, may be manufactured of any water impervious material, such as polyurethane, aluminum, steel or the like, it being understood that any material which will perform the function of acting as a water barrier when sandwiched between two members of shower or bath tub enclosures are desired. Flashing member 70 may be used to join coplanar wall section members 25, or to join perpendicularly arranged sections 20 and/or 25 as shown in FIG. 12A. Also, the L-shaped flashing member 30' shown in FIG. 5 may be employed at a vertical seam in place of flashing member 70, as shown in FIG. 12B. Legs 72, 76 form a right angle (or angle corresponding generally to the angle formed between adjoining wallboard or shower enclosure components) such that each of legs 72,76 will lie upon one of the surfaces F of the adjoining wallboard or shower enclosure components.

In one embodiment, the installation of flashing 30 may be accomplished by placing shower pan 10 (or equivalent section of wallboard) in place, attaching flashing 30 in position with respect thereto against whatever backing material will lie behind wallboard 25 (such as wall stud "S"), installing wallboard 25, and tiling thereover or covering with whatever finishing surfacing material is to be used. Alternatively, flashing 30 may be installed against whatever backing material will lie behind wallboard 25, placing shower pan 10 (or equivalent section of wallboard) in position, installing wallboard 25 and covering with finishing material.

Figure 15A:
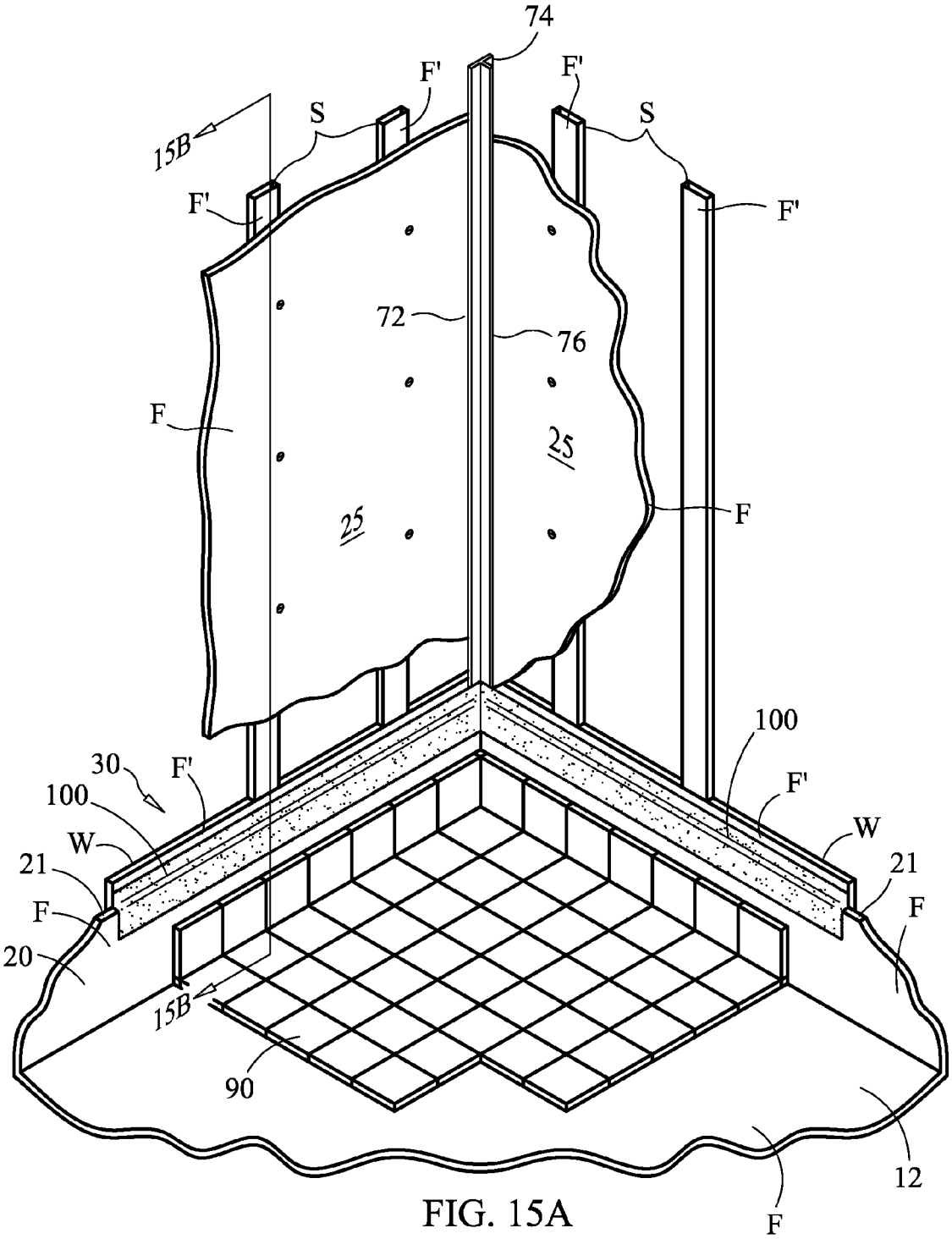
FIG. 15A is a perspective view of yet another embodiment of the flashing of this invention.
Figure 15B:
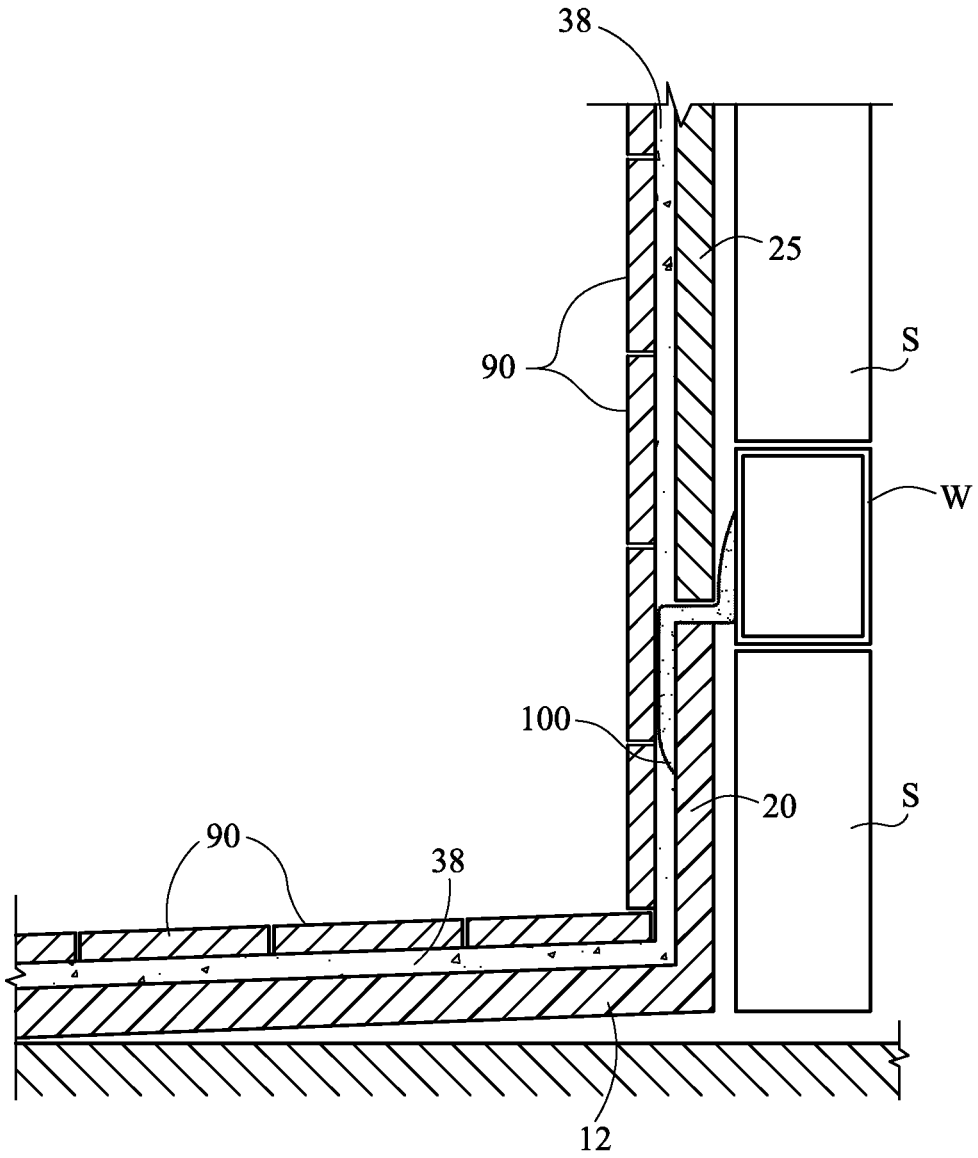
FIG. 15B is a cross-sectional elevational view of the flashing arrangement shown in FIG. 15A.

FIGS. 15A and 15B depict another embodiment of the invention, in which a roll-on-type waterproofing membrane 100, such as the product sold under the trademark "Hydro Ban™ by Laticrete Int'l Inc. of Bethany, Connecticut", is applied over the intersection of a wallboard and shower pan sidewall section 20 or 25 (which intersection may also be between adjacent wallboard sections and/or adjacent shower/tub enclosure sections, as the case may be) and a generally horizontally disposed backing member such as wall framing member W to form a flashing arrangement. Framing member W forms a front (shower-facing) surface F1 which is substantially coplanar with the front facing surfaces F1 of wall studs S. The mid-point of framing member W is generally at about the height of top edge 21 of pan sidewall 20. In this embodiment, upper peripheral edge 21 of pan sidewall 20 is generally perpendicular to vertical front face F' of framing member W and studs "S" such that membrane 100 forms a watertight covering over the intersection thereof. As shown, the membrane 100 may, but is not necessarily required to, cover all or a portion of the front surface of sidewall 20 as well.

This waterproofing arrangement can be created at any vertical or horizontal seam created by the placement of wall or shower pan sections next to each other. Installation of this type of waterproof juncture may be carried out by, for example, providing a horizontally arranged wall framing member "W" in coplanar relationship with wall studs "S", placing shower pan 20 or wallboard section 25 in place against the co-planar front-facing surfaces F' of studs "S" and framing members "W", and applying the membrane material 100 in liquid or otherwise flowable form. Thereafter, another wallboard section (or equivalent shower or tub component) may be installed above upper peripheral edge 21. The same procedure may be carried out for vertically or diagonally oriented seams. The material which forms membrane 100 may be applied by rolling, spraying, brushing, trowelling, or the like as will occur to those of skill in the art.

The shower pan referenced herein may be made of any suitable material, such as polyurethane. The flashing members of this invention may be manufactured of any water impervious material, such as polyurethane, plastic, aluminum, steel or the like, it being understood that any material which will perform the function of acting as a water barrier when sandwiched between two wall members of shower or bath tub enclosures, being formed having a horizontal section sandwiched between wall member peripheral edges and a substantially vertical member extending upwardly from the horizontal section behind the upper wall member.

In the foregoing specification, the present invention has been described with reference to specific embodiments. However, one of ordinary skill in the art will appreciate that various modifications and changes may be made without departing from the spirit and scope of the present invention as set forth in the appended claims. Accordingly, the specification and drawings are to be regarded in an illustrative rather than a restrictive sense, and all such modifications are intended to be included within the scope of the present invention.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made while this application is pending and all equivalents of those claims as issued.

What is claimed is:

1. A waterproof flashing used to seal a joint between first and second wall members, the first wall member being disposed substantially vertically and ending in a first peripheral substantially horizontally oriented edge, the second wall member being disposed substantially vertically and ending in a second peripheral substantially horizontally oriented edge, the first and second peripheral edges facing each other in substantial registry and forming a space therebetween, the flashing comprising:

a Z-shaped flashing member at least partially sandwiched between the first and second peripheral edges, the flashing member comprised of a first, substantially horizontally disposed, section extending in the space between the first and second peripheral edges, the first section having a thickness;

a second, upstanding, section which is attached to the first section along a distal edge of the first section and extending substantially vertically upwardly behind at least a portion of the second wall member when installed;

a third, downwardly depending, section which is attached to the first section along a proximal edge of the first section and extending substantially downwardly in front of at least a portion of the first wall member when installed;

a row of tile applied over a projected area occupied by the space between the first and second peripheral edges and the flashing; and the first and second peripheral edges being spaced from each other by no more than substantially the thickness of the first section of the flashing member.

2. The waterproof flashing of claim 1, further comprising a resilient sealing agent disposed in and substantially filling the space between the first and second peripheral edges.

3. The waterproof flashing of claim 1, further comprising one or more fasteners to mechanically connect the flashing to one or more fixed objects, wherein the fixed object(s) is a wall stud lying behind one or both of the first and second wall members.

4. A waterproof flashing used to seal a joint between a vertically oriented wallboard member, the wallboard member ending in a first substantially horizontally oriented peripheral edge, and a vertically oriented sidewall of a shower or bath tub module, the sidewall of the shower or bath tub enclosure ending in a second substantially horizontally oriented peripheral edge, the first and second peripheral edges directly opposing each other, being in substantial registry with each other, and defining a space between each other, the flashing comprising:

a z-shaped flashing member comprised of a first section extending substantially horizontally in the space between the first and second peripheral edges, the first section having a thickness;

a second, upstanding, section which is attached to the first section along a distal edge of the first section and extending substantially vertically upwardly behind at least a portion of the wallboard member;

a third, downwardly depending, section which is attached to the first section along a proximal edge of the first section and extending substantially downwardly in front of at least a portion of the sidewall member when installed;

a row of tile applied over the space between the first and second peripheral edges and the flashing; and the first and second peripheral edges being spaced from each other by no more than substantially the thickness of the first section of the flashing member.

5. A waterproof flashing used to seal a joint between a first member, said first member consisting of one or more of a sidewall of a shower pan, a back wall of a shower bench, a shower accessory or a sidewall of a bath tub module, and a second member, said second member consisting of one or more of a legwall of a shower bench, a wallboard or a shower accessory, the first member being vertically oriented and ending in a first peripheral edge, the second member being vertically oriented and ending in a second peripheral edge, the first and second peripheral edges being substantially parallel to, directly opposing and in registry with each other, the flashing comprising:

a z-shaped flashing member comprised of a first section extending substantially horizontally in a space between the first and second peripheral edges, the first section having a thickness;

a second, upstanding, flashing member which is attached to the first flashing member along a distal edge of the first flashing member and extending substantially vertically upwardly behind at least a portion of the second member when installed;

a third, downwardly depending, section which is attached to the first section along a proximal edge of the first section and extending substantially downwardly in front of at least a portion of the first member when installed;

the first and second peripheral edges being spaced from each other by no more than substantially the thickness of the first section of the flashing member;

a row of tile applied over a projected area defined by the space when viewed in elevation.

6. The waterproof flashing of claim 5, further comprising a row of tile applied over a projected area occupied by the space between the first and second peripheral edges and the flashing.

7. The waterproof flashing of claim 5, further comprising one or more fasteners to mechanically connect the flashing to one or more fixed objects.

8. The waterproof flashing of claim 7, wherein the one or more fixed objects is a wall stud disposed behind the first and second wall members.

9. The waterproof flashing of claim 5, further comprising a resilient sealing agent disposed in and substantially filling the space between the first and second peripheral edges and at least partially encapsulating the first section.

10. The waterproof flashing of claim 9, further comprising a row of tile applied over a projected area occupied by the space between the first and second peripheral edges and the third flashing section.

11. A waterproof flashing used to seal a joint between first and second wall members, the first wall member being substantially vertically oriented and ending in a first peripheral edge, the second wall member being substantially vertically oriented and ending in a second peripheral edge, the first and second peripheral edges facing each other in directly opposed relation and being in registry with, and defining a space between, each other, the flashing comprising:

a z-shaped flashing member comprised of a first section adapted to be placed in a space formed between the first and second peripheral edges, the first section having a thickness;

a second, upstanding, section attached along a first peripheral edge of the first section, and a third, downwardly depending, section attached along a second peripheral edge of the first section;

the second section adapted to be placed in sealing engagement against a rear surface of the first wall section when installed;

the third section adapted to be placed in sealing engagement against a front surface of the second wall section when installed;

the first section being water-impermeable such that water is prevented from passing through the space between the first and second peripheral edges;

the first and second peripheral edges being spaced from each other by a distance which is no more than substantially the thickness of the first section of the flashing member;

a row of tile applied over a projected area bounded by the space between the first and second peripheral edges when viewed in elevation.

12. The waterproof flashing of claim 11, further comprising one or more courses of tile applied over an area occupied by the space between the first and second peripheral edges.

13. The waterproof flashing of claim 11, further comprising one or more fasteners to mechanically connect the flashing member to a fixed object.

14. The waterproof flashing of claim 13, wherein the fixed object is one or more wall stud(s) lying behind the first and second wall members.

15. The waterproof flashing of claim 11, further comprising a resilient sealing agent disposed in and substantially filling the space between the first and second peripheral edges and at least partially encapsulating the first section.

* * * * *